US008864632B2

(12) United States Patent
Johnson

(10) Patent No.: US 8,864,632 B2
(45) Date of Patent: Oct. 21, 2014

(54) EXERCISE APPARATUS AND METHOD

(75) Inventor: Kim Johnson, Ashburn, VA (US)

(73) Assignee: Gartay LLC, Ashburn, VA (US)

( * ) Notice: Subject to any disclaimer, the term of this patent is extended or adjusted under 35 U.S.C. 154(b) by 132 days.

(21) Appl. No.: 13/267,535

(22) Filed: Oct. 6, 2011

(65) Prior Publication Data

US 2013/0090218 A1 Apr. 11, 2013

(51) Int. Cl.

| | |
|---|---|
| ***A63B 23/08*** | (2006.01) |
| ***A63B 21/00*** | (2006.01) |
| ***A63B 21/04*** | (2006.01) |
| ***A63B 21/055*** | (2006.01) |
| ***A63B 22/20*** | (2006.01) |
| *A63B 22/00* | (2006.01) |

(52) U.S. Cl.

CPC ..... *A63B 21/0442* (2013.01); *A63B 21/0552* (2013.01); *A63B 22/20* (2013.01); *A63B 2022/0038* (2013.01); *A63B 2022/0097* (2013.01); *A63B 2208/0233* (2013.01)

USPC ..... 482/79; 482/124; 482/131

(58) Field of Classification Search

CPC ..... A63B 21/0442; A63B 21/143; A63B 2208/0204; A63B 21/00185; A63B 2071/027; A63B 21/1423; A63B 2208/0228; A63B 69/3608; A63B 2023/006; A63B 21/1403; A63B 21/1442; A63B 2208/0233; A63B 22/20; A63F 2200/055; A63F 2005/008; A61H 2201/164; A44C 3/001; A61F 5/0111; A61F 5/0113; A61F 5/3715; G09F 3/207

USPC ..... 482/71, 121, 122, 124, 125, 126, 79, 482/131

See application file for complete search history.

(56) References Cited

U.S. PATENT DOCUMENTS 4,121,827 A * 10/1978 Weider ..... 482/125
4,930,767 A * 6/1990 Hamm ..... 482/80

(Continued)

FOREIGN PATENT DOCUMENTS

JP 3082959 U 1/2002
JP 3102057 U 7/2004

(Continued)

OTHER PUBLICATIONS

International Search Report and Written Opinion issued in PCT Application No. PCT/US2012/052218, mailed on Feb. 1, 2013.

(Continued)

*Primary Examiner* — Loan H Thanh
*Assistant Examiner* — Sundhara Ganesan
(74) *Attorney, Agent, or Firm* — Christopher B. Kilner

(57) ABSTRACT

An exercise apparatus and method allows a user to perform exercises while seated or otherwise supported. Such exercises can assist in avoiding DVT and help those who otherwise might have difficulty exercising due to various conditions. The apparatus requires a base element formed of substantially flat sheet material dimensioned to accommodate a portion of a user's foot, and a leash element attached to a periphery of the base element and dimensioned for retention of the base element. The sheet material reduces friction between a user's foot and the exercise surface to allow a user to exercise their lower extremities via a sliding motion. The leash element allows the base element to be deployed to a floor or other surface for use, and then retrieved without requiring the user to bend over. The leash element is preferably formed of elastic to allow resistive forces to be applied to the base element.

13 Claims, 4 Drawing Sheets

(56) References Cited

U.S. PATENT DOCUMENTS

| | | | | |
|---|---|---|---|---|
| 5,308,305 | A * | 5/1994 | Romney | 482/124 |
| 5,941,802 | A * | 8/1999 | Kiser | 482/92 |
| 6,063,010 | A * | 5/2000 | Howd et al. | 482/79 |
| 6,361,516 | B1 * | 3/2002 | Hamel | 602/27 |
| 6,368,256 | B1 * | 4/2002 | Rumbaugh | 482/121 |
| 6,368,258 | B1 * | 4/2002 | Emlaw | 482/124 |
| 6,425,844 | B1 * | 7/2002 | Azar | 482/79 |
| 6,450,930 | B1 * | 9/2002 | Kroke | 482/121 |
| 7,087,003 | B1 | 8/2006 | Katterjohn | |
| 7,104,935 | B2 * | 9/2006 | Matsuoka | 482/124 |
| 7,354,413 | B2 * | 4/2008 | Fisher | 602/29 |
| 8,142,336 | B1 * | 3/2012 | Yates | 482/124 |
| 2003/0134685 | A1 * | 7/2003 | Piatt | 473/208 |
| 2004/0068832 | A1 * | 4/2004 | Edwards | 16/42 R |
| 2007/0287605 | A1 * | 12/2007 | Mylrea et al. | 482/92 |
| 2008/0039303 | A1 * | 2/2008 | Wilcocks | 482/124 |
| 2009/0149303 | A1 | 6/2009 | Meisterling | |
| 2011/0118094 | A1 * | 5/2011 | Kissner et al. | 482/131 |

FOREIGN PATENT DOCUMENTS

| | | | |
|---|---|---|---|
| JP | 2009-261861 | A | 11/2009 |
| WO | 02058798 | A1 | 8/2002 |

OTHER PUBLICATIONS

Notice of and International Preliminary Report on Patentability issued for International Application No. PCT/US2012/052218 mailed on Apr. 17, 2014.

* cited by examiner

EXERCISE APPARATUS AND METHOD

BACKGROUND

Deep vein thrombosis (DVT) is a condition in which a blood clot (thrombus) forms in one or more of the deep veins in a person's body, usually in the legs. DVT can cause leg pain, but often occurs without any symptoms. DVT can develop if a person sits still for a long time, such as when traveling by plane or car, or if the person has certain medical conditions that affect how blood clots. DVT is a serious condition because a blood clot that has formed in a vein can break loose, travel through the bloodstream and lodge in a person's lungs, blocking blood flow (pulmonary embolism).

To reduce the possibility of DVT, doctors recommend exercising of lower calf muscles for anyone who may be sitting for a long time, such as by getting up and walking around. However, there are many situations where walking around is not possible or convenient. For example, when flying in an airplane, passengers are often restricted to their seats due to turbulence. Other examples where walking around is not possible include those restricted to bed rest, because of surgery or other conditions, as well as injured, aged or infirm individuals.

Beyond DVT prevention, exercise has additional benefits including, but not limited to, increasing blood circulation, improving flexibility and range of motion, strengthening muscles and joints, lowering blood pressure, and burning calories.

BRIEF SUMMARY

Embodiments disclosed herein provide an exercise apparatus and method that can be used to perform exercises while seated or otherwise supported. Such exercises can assist in avoiding DVT and can help those who otherwise might have difficulty exercising due to various conditions. The exercise apparatus consists essentially of a base element formed of a substantially flat sheet material dimensioned to accommodate a portion of a user's foot, and a leash element that is attached to a periphery of the base element and dimensioned for retention of the base element. The sheet material reduces friction between a user's foot and the exercise surface so as to allow a user to exercise their lower extremities via a sliding motion. The leash element allows the base element to be deployed to a floor or other surface for use, and then retrieved without requiring the user to bend over.

DETAILED DESCRIPTION

As used herein, the term "foot" (and plural, "feet") refers to a user's foot, whether bare or covered by a sock, shoe, cast, orthopedic boot, etc., as well as a prosthetic foot and/or the lower-most portion of a leg of a user without a foot due to a congenital birth defect or an injury. As used herein, the terms "seated" and "sitting" refer to users in chairs, benches, couches, stools, passenger seats, wheelchairs, cockpits, adjustable beds, and the like wherein a user is at least partially supported so as to be able to relieve their full weight from their feet. The term "substantially flat sheet material" refers to materials that assume a generally flat orientation when placed upon a flat supporting surface. The term "reduced friction" refers to levels of static and dynamic friction (i.e., coefficients of friction) lower than typically found with bare feet and shoe soles so as to allow a bare or shoed foot to slide more easily on a support surface such as a bare floor or carpet.

Figure 1:
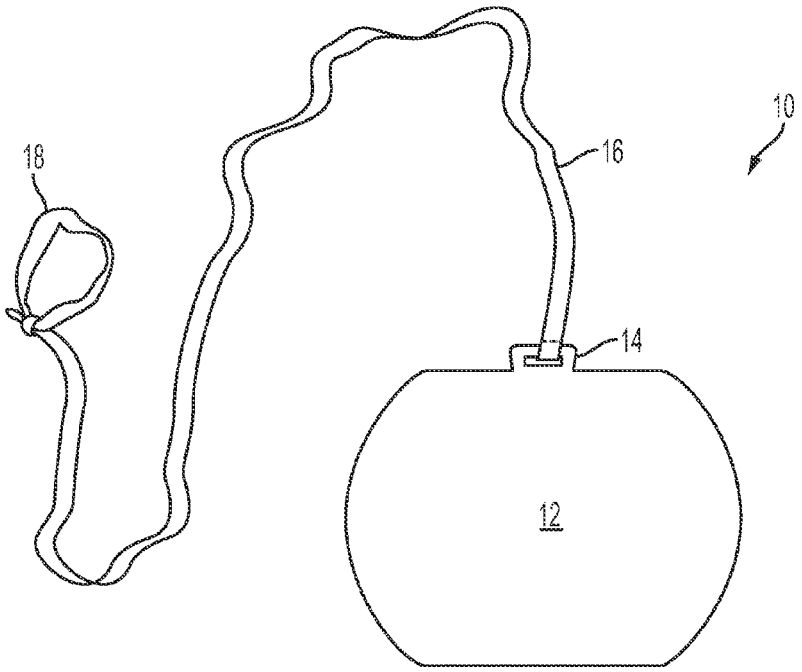
FIG. 1 illustrates an embodiment of an exercise apparatus.

One embodiment of an exercise apparatus 10 is illustrated in FIG. 1. The disclosed exercise apparatus 10 is simple to make and use, and only requires two basic components. The first component is a base element 12 formed of a substantially flat sheet material. The second component is a leash element 16. While it is possible to use a flexible sheet such as a fabric for the base element 12, it is preferred to use a sheet material with sufficient rigidity to prevent the sheet material from wrinkling, buckling and/or folding when being used. At least the bottom side of the sheet material may have a coating or be formed of a smooth material so as to have a reduced friction level (i.e., reduced coefficient of friction). The upper side of the sheet material may optionally be textured, embossed or coated with a material to improve the grip between the upper side of the base element 12 and a user's foot 22. Numerous plastic sheet materials with thicknesses between approximately 0.1 mm and 1.0 mm, and preferably between approximately 0.4 mm and 0.7 mm, have been found to be suitable for use in fabricating the base element 12.

Figure 2:
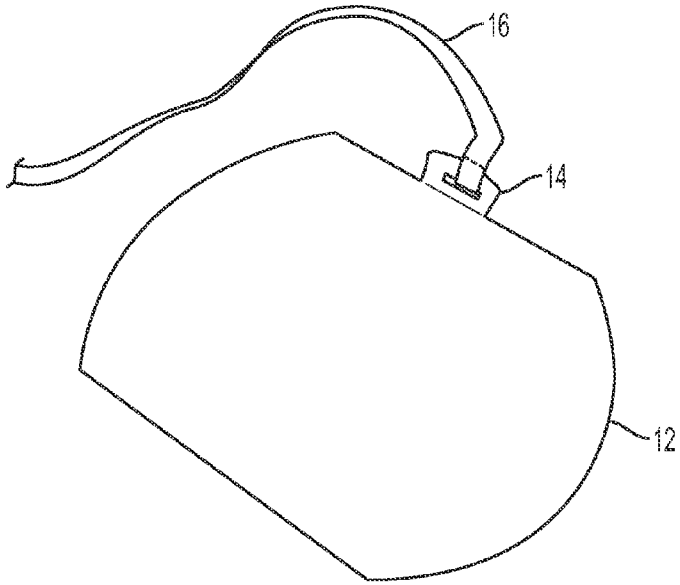
FIG. 2 illustrates an alternate view of the embodiment of FIG. 1.

In an embodiment, a sheet of isotactic polypropylene with a thickness of 0.7 mm that is typically employed for cutting mats (cooking) was used to produce a base element 12 as illustrated in FIGS. 1 and 2. The rigidity and coefficient of friction (static and dynamic) of such material is suitable for use in embodiments disclosed herein. As illustrated in FIG. 2, the base element 12 may have a slight concave curvature to allow it to slide more easily, but this is not a requirement. A tab element 14 can extend above the top surface of base element 12 adjacent to the periphery. Alternately, the leash 16 can be bonded or otherwise attached to the top of the base element adjacent the periphery (not illustrated). In the illustrated embodiment, the base element 12 was dimensioned approximately 12.5 cm wide and 17.5 cm long, with radiused edges at the ends. A base element 12 with these dimensions was found to be able to accommodate foot/shoe sizes up to a men's US size 15. However, other dimensions are also possible, and dimensions between approximately 10 cm-20 cm wide and approximately 10 cm-30 cm long, and more particularly with a width between 11 cm-14 cm and a length between 15 cm-20 cm, remain suitable.

While plastic, and in particular isotactic polypropylene, have been found suitable for base element 12, numerous other sheet materials may also be used, including but not limited to, fabric, coated fabric, silicone, leather, wood, paper, cardboard, and combinations thereof. Indeed, while not preferred, even metal or glass sheet material is possible to use. For certain applications, it may be desirable to minimize the sound produced when the base element is slid along a floor or other intended exercise surface. For example, when used on carpets, thinner and smoother sheets of some plastics have been found to reduce the volume of the sliding sound. Accordingly, material choices for the base element may depend on the intended application (e.g., wood floor v. carpet, tile v.

wood floor, etc.) and material choices should also be selected to avoid materials that may mar or scuff the intended exercise surface or cause other undesirable side effects, such as the build-up of static electricity.

As illustrated in FIG. 1, the exercise apparatus 10 includes a leash element 16. The leash element 16 can be formed as a string, cord or a band of any suitable material, and may be dimensioned so that a user can hold a free end of the leash element while the user's foot is on the base element. The leash element 16 is attached to the base element at only one end and has a free end that can be used to retain the base element 12 so as to retrieve it from a floor or to add resistance to an exercise. The illustrated leash element 16 includes a loop 18 formed in the free end to assist in retaining the leash element 16. Such a loop 18 is not required, and other elements such as handles, clips, buckles, etc. (not shown) may also be used at the free end of leash element 16 to assist in retaining the base element 12.

In an embodiment, the leash element 16 is dimensioned approximately 45 cm-135 cm long. In a preferred embodiment, the leash element 16 is formed, at least in part, of an elastic band or cord and has a length approximately 90 cm long. The elasticity of such a band or cord allows the leash element 16 to easily supply a resistance force to the base element 12 when used for exercise. While disclosed as a band or cord, the leash element 16 may also comprise portions of rigid elements (not shown) without departing from the scope of this disclosure. When base element 12 is formed of a disposable/recyclable material such as cardboard or paper, it is further preferable that leash element 16 also be formed of a disposable/recyclable material, such as paper or string.

The exercise apparatus 10 can be used in various manners to perform numerous exercises while seated or otherwise supported. Accordingly, airplane passengers can perform exercises while in their passenger seat to assist in avoiding DVT, the aged and infirm can perform exercises without fear of falling, and the injured can perform physical therapy without placing undue weight on injured joints or muscles. The leash allows the exercise apparatus 10 to be used (i.e., deployed to a floor) and retrieved without ever requiring the user to bend over. Accordingly, the apparatus is easier to use in confined areas such as airline seats, train seats, cockpits, etc. Further, the apparatus may be used by those with limited mobility (aged, infirm, injured) since gravity can be used to deploy the base element 12 to a floor and the leash element 16 can be used to retrieve the base element.

Figure 3:
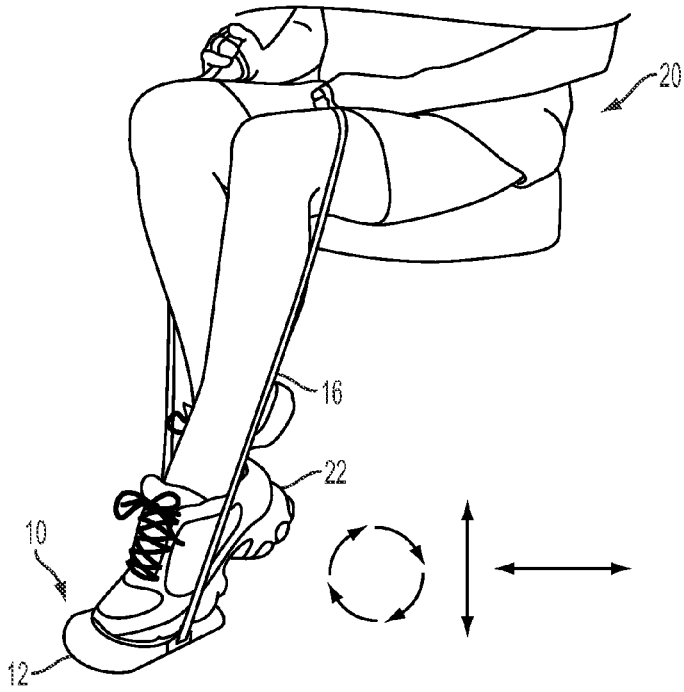
FIG. 3 illustrates a plantar flexion and extension exercise using an embodiment of an exercise apparatus.

As illustrated in FIG. 3, the free end of leash element 16 can be held by a user 20 while in a seated position when the user's foot 22 is positioned on base element 12 of exercise apparatus 10. FIG. 3 illustrates a plantar flexion and extension exercise performed with a pair of exercise apparatus 10, one for each foot. In this exercise, a user places the ball of their foot on the base element 12 and slides the base elements 12 in a circular pattern, back and forth, and/or side to side. Such exercises work the knee and ankle joints and exercise various muscles, including the quadriceps, hamstrings, gastrocnemius, soleus, popliteus, and peroneus muscles.

Figure 4:
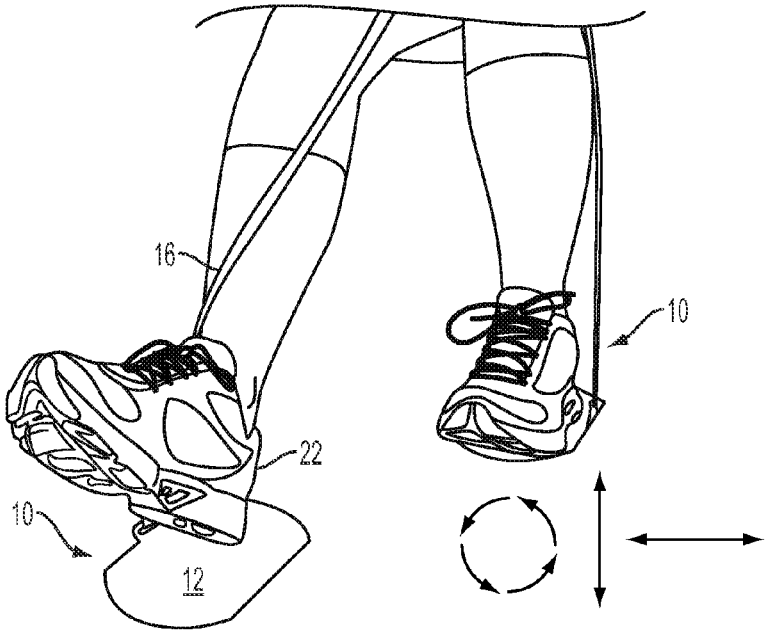
FIG. 4 illustrates a dorsiflexion exercise using an embodiment of an exercise apparatus.

FIG. 4 illustrates a dorsiflexion exercise performed with a pair of exercise apparatus 10, one for each foot. In this exercise, a user places the heel of their foot on the base element 12 and slides the base elements 12 in a circular pattern, back and forth, and/or side to side. Such exercises work the knee and ankle joints and exercise various muscles, including the quadriceps, hamstrings, popliteus, tibialis anterior, extensor digitorun longus, and peroneus tertius muscles.

Figure 5:
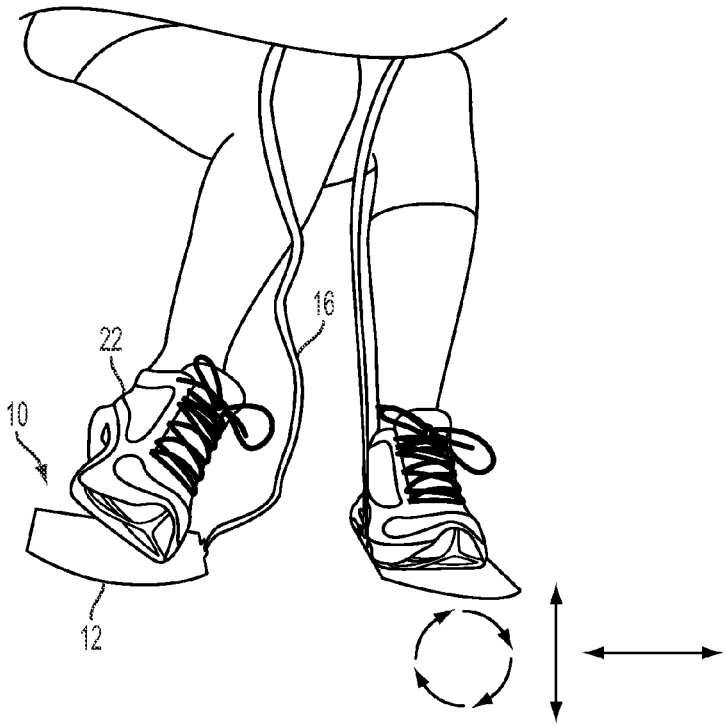
FIG. 5 illustrates an eversion exercise using an embodiment of an exercise apparatus.

FIG. 5 illustrates an eversion exercise performed with a pair of exercise apparatus 10, one for each foot. In this exercise, a user places the inside ball of their foot on the base element 12 and slides the base elements 12 in a circular pattern, back and forth, and/or side to side. Such exercises work the knee and ankle joints and exercise various muscles, including the extensor digitorun longus, peroneus tertius, peroneus longus, and peroneus brevis muscles.

Figure 6:
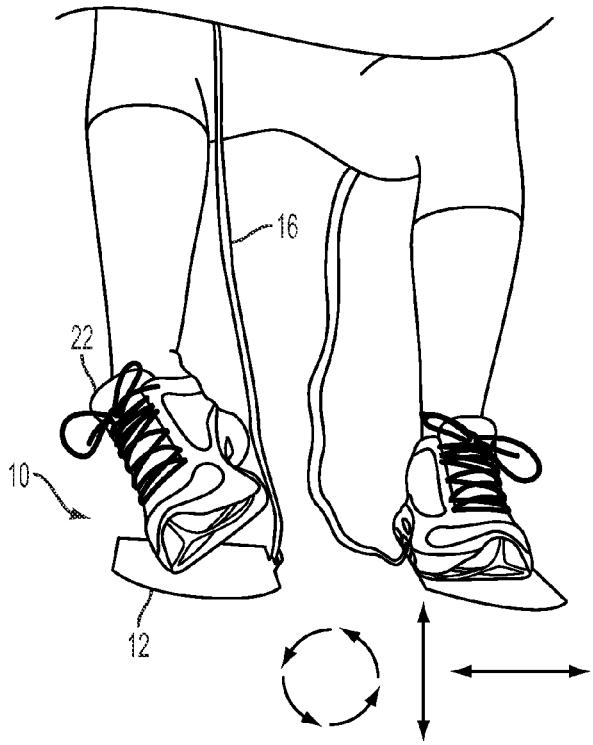
FIG. 6 illustrates an inversion exercise using an embodiment of an exercise apparatus.

FIG. 6 illustrates an inversion exercise performed with a pair of exercise apparatus 10, one for each foot. In this exercise, a user places the outside ball of their foot on the base element 12 and slides the base elements 12 in a circular pattern, back and forth, and/or side to side. Such exercises work the knee and ankle joints and exercise various muscles, including the tibialis anterior and tibialis posterior muscles.

Figure 7:
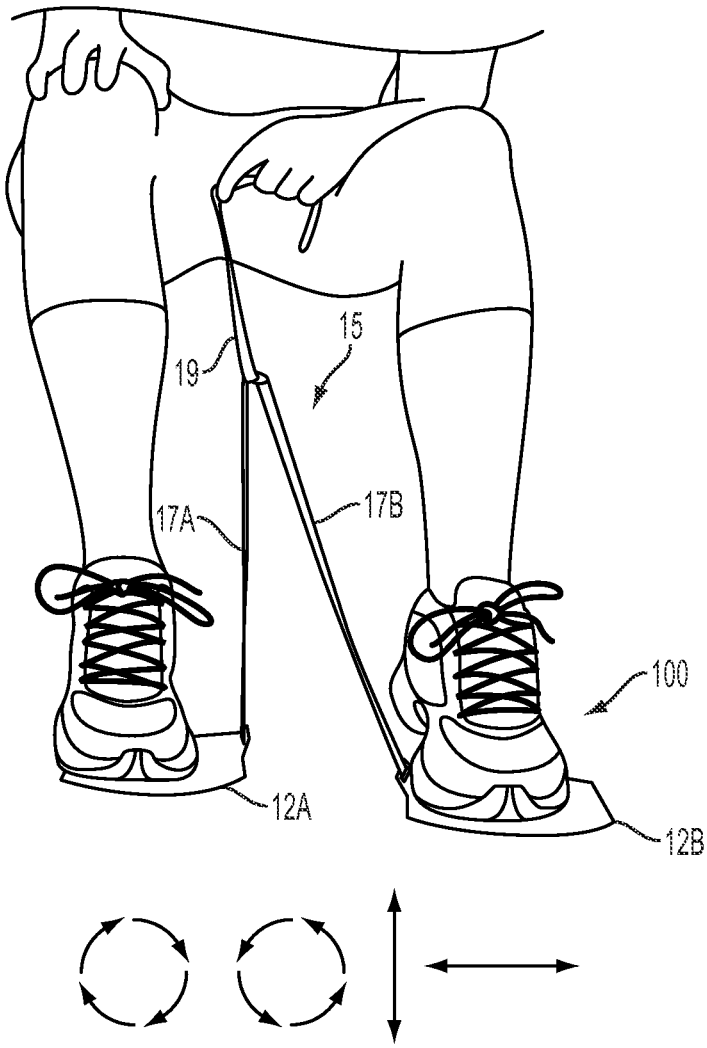
FIG. 7 illustrates an alternative embodiment of an exercise apparatus.

FIG. 7 illustrates a plantar flexion and extension exercise performed with an alternative embodiment of apparatus 100 that comprises a single Y-shaped leash 15 attached to first and second base elements 12A, 12B so as to provide one for each foot. The Y-shaped leash element 15 has first and second attached ends 17A and 17B and a free end 19, the first attached end 17A attached to and extending from a position adjacent a periphery of the first base element 12A, and the second attached end 17B attached to and extending from a position adjacent a periphery of the second base element 12B. In such an embodiment, the user needs only one hand to retain the device and can retrieve both base elements together. This arrangement also keeps the elements connected for storage/transport. In this exercise, similar to FIG. 3, a user places the balls of their feet on the first and second base elements 12A and 12B and slides the first and second base elements 12A and 12B in a circular pattern, back and forth, and/or side to side. Such exercises work the knee and ankle joints and exercise various muscles, including the quadriceps, hamstrings, gastrocnemius, soleus, popliteus, and peroneus muscles.

In a first embodiment, an exercise apparatus consists essentially of a base element for placement of at least a portion of a user's foot and a leash element attached at only one end to the base element. The base element consists of a substantially flat sheet of material dimensioned approximately 10 cm-20 cm wide and approximately 10 cm-30 cm long. The leash element is attached to and extends from a position adjacent a periphery of the base element and is dimensioned approximately 45 cm-135 cm long.

In a variation of the first embodiment, the base element can consist of a substantially flat sheet of plastic. This substantially flat sheet of plastic can have a thickness between approximately 0.1 mm and 1.0 mm, and preferably the substantially flat sheet of plastic has a thickness between approximately 0.4 mm and 0.7 mm. In another variation of the first embodiment, the base element may also consist of a substantially flat sheet of isotactic polypropylene. This substantially flat sheet of isotactic polypropylene may have a thickness between approximately 0.1 mm and 1.0 mm, and preferably the substantially flat sheet of isotactic polypropylene has a thickness between approximately 0.4 mm and 0.7 mm. The substantially flat sheet of isotactic polypropylene may also have width between 11 cm-14 cm and a length between 15 cm-20 cm. In any of these variations of the first embodiment, the leash element may be an elastic member selected from the group consisting of elastic cords and elastic bands.

In another variation of the first embodiment, the leash element may be attached to and extending from a tab adjacent a periphery of the base element. In yet another variation of the first embodiment, at least a portion of the periphery of the base element is curved.

In a second embodiment, an exercise apparatus consists essentially of first and second base elements for placement of at least a portion of a user's first and second foot, and a Y-shaped leash element. The first and second base elements consist of substantially flat sheets of material, each dimensioned approximately 10 cm-20 cm wide and approximately 10 cm-30 cm long. The Y-shaped leash element has first and second attached ends and a free end, with the first attached end attached to and extending from a position adjacent a periphery of the first base element, and the second attached end attached to and extending from a position adjacent a periphery of the second base element.

In a first variation of the second embodiment, the first and second base elements consist of a substantially flat sheets of isotactic polypropylene of a thickness between approximately 0.4 mm and 0.7 mm. In a second variation of the second embodiment, the Y-shaped leash element is an elastic member selected from the group consisting of elastic cords and elastic bands.

A third embodiment comprises a method of using an exercise apparatus, the method consisting essentially of: positioning at least a portion of a user's foot on a base element, wherein the base element consists of a substantially flat sheet of material dimensioned approximately 10 cm-20 cm wide and approximately 10 cm-30 cm long; exercising by sliding the base element on a surface under a force of the user's foot, wherein the base element reduces friction between the user's foot and the surface; and retaining the base element with a leash element attached at only one end to the base element, the leash element attached to and extending from a position adjacent a periphery of the base element and dimensioned approximately 45 cm-135 cm long.

In a variation of the third embodiment, the method further comprises providing a resistance force to the base element via the leash element. Optionally, a free end of the leash element can be retained and the resistance force provided by elastic portions of the leash element. In another variation of the third embodiment, the user performs the exercising from a seated position.

An exercise apparatus and method has been described. It will be understood by those skilled in the art that the present invention may be embodied in other specific forms without departing from the scope of the invention disclosed and that the examples and embodiments described herein are in all respects illustrative and not restrictive. Those skilled in the art of the present invention will recognize that other embodiments using the concepts described herein are also possible. Further, any reference to claim elements in the singular, for example, using the articles "a," "an," or "the" is not to be construed as limiting the element to the singular.

What is claimed is:

1. An exercise apparatus, consisting essentially of:

a base element for placement of at least a portion of a user's foot, the base element consisting of a substantially flat sheet of plastic with a tab region at a periphery, the flat sheet of plastic having a thickness between approximately 0.1 mm and 1.0 mm and dimensioned approximately 10 cm-20 cm wide and approximately 10 cm-30 cm long, wherein a bottom side of the sheet of plastic has a reduced coefficient of friction that is sufficiently below that of the user's foot or a shoe sole and adapted to allow the user's foot or shoe sole to easily slide on a support surface in use, and the sheet of plastic has sufficient rigidity to prevent wrinkling, buckling, or folding in use; and a leash element attached at only one end to the base element, the leash element attached to and extending from the tab region of the base element and dimensioned approximately 45 cm-90 cm long.

2. The exercise apparatus of claim 1, wherein the substantially flat sheet of plastic has a thickness between approximately 0.4 mm and 0.7 mm.

3. The exercise apparatus of claim 1, wherein the base element consists of a substantially flat sheet of isotactic polypropylene.

4. The exercise apparatus of claim 3, wherein the substantially flat sheet of isotactic polypropylene has a thickness between approximately 0.4 mm and 0.7 mm.

5. The exercise apparatus of claim 4, wherein the leash element is an elastic member selected from the group consisting of elastic cords and elastic bands.

6. The exercise apparatus of claim 4, wherein the substantially flat sheet of isotactic polypropylene has a width between 11 cm-14 cm and a length between 15 cm-20 cm.

7. The exercise apparatus of claim 6, wherein the leash element is an elastic member selected from the group consisting of elastic cords and elastic bands.

8. The exercise apparatus of claim 1, wherein the leash element is an elastic member selected from the group consisting of elastic cords and elastic bands.

9. The exercise apparatus of claim 1, wherein at least a portion of the periphery of the base element is curved.

10. An exercise apparatus, consisting essentially of:

a first base element for placement of at least a portion of a user's foot, the first base element consisting of a substantially flat sheet of plastic having a tab region at a periphery and dimensioned approximately 10 cm-20 cm wide and approximately 10 cm-30 cm long, wherein a bottom side of the sheet of plastic of the first base element has a reduced coefficient of friction that is sufficiently below that of the user's foot or a shoe sole and adapted to allow the user's foot or shoe sole to easily slide on a support surface in use, and the sheet of plastic of the first base element has sufficient rigidity to prevent wrinkling, buckling, or folding in use;

a second base element for placement of at least a portion of a user's foot, the second base element consisting of a substantially flat sheet of plastic having a tab region at a periphery and dimensioned approximately 10 cm-20 cm wide and approximately 10 cm-30 cm long, wherein a bottom side of the sheet of plastic of the second base element has a reduced coefficient of friction that is sufficiently below that of the user's foot or a shoe sole and adapted to allow the user's foot or shoe sole to easily slide on a support surface in use, and the sheet of plastic of the second base element has sufficient rigidity to prevent wrinkling, buckling, or folding in use; and a Y-shaped leash element with first and second attached ends and a free end, the first attached end attached to and extending from the tab region of the first base element, and the second attached end attached to and extending from the tab region of the second base element.

11. The exercise apparatus of claim 10, wherein the first and second base elements consist of a substantially flat sheets of isotactic polypropylene of a thickness between approximately 0.4 mm and 0.7 mm.

12. The exercise apparatus of claim 10, wherein the Y-shaped leash element is an elastic member selected from the group consisting of elastic cords and elastic bands.

13. An exercise apparatus, consisting essentially of:

a first base element for placement of at least a portion of a user's foot, the first base element consisting of a substantially flat sheet of plastic having a tab region at a periphery, the flat sheet of plastic having a thickness between approximately 0.1 mm and 1.0 mm and dimensioned approximately 10 cm-20 cm wide and approximately 10 cm-30 cm long, wherein a bottom side of the sheet of plastic of the first base element has a reduced coefficient of friction that is sufficiently below that of the user's foot or a shoe sole and adapted to allow the user's foot or shoe sole to easily slide on a support surface in use, and the sheet of plastic of the first base element has sufficient rigidity to prevent wrinkling, buckling, or folding in use;

a second base element for placement of at least a portion of a user's foot, the second base element consisting of a substantially flat sheet of plastic having a tab region at a periphery, the flat sheet of plastic having a thickness between approximately 0.1 mm and 1.0 mm and dimensioned approximately 10 cm-20 cm wide and approximately 10 cm-30 cm long, wherein a bottom side of the sheet of plastic of the second base element has a reduced coefficient of friction that is sufficiently below that of the user's foot or a shoe sole and adapted to allow the user's foot or shoe sole to easily slide on a support surface in use, and the sheet of plastic of the second base element has sufficient rigidity to prevent wrinkling, buckling, or folding in use; and a Y-shaped leash element with first and second attached ends and a free end, the first attached end attached to and extending from the tab region of the first base element, and the second attached end attached to and extending from the tab region of the second base element.

* * * * *